US005845611A

United States Patent [19]

Schmidt et al.

[11] Patent Number: 5,845,611

[45] Date of Patent: Dec. 8, 1998

[54] LIQUID-COOLED PISTON FOR INTERNAL COMBUSTION ENGINES

[75] Inventors: Erwin Schmidt, Baltmannsweiler; Siegfried Sumser, Stuttgart; Edgar Martin, Nürnberg, all of Germany

[73] Assignee: Daimler-Benz AG, Stuttgart, Germany

[21] Appl. No.: 848,400

[22] Filed: May 8, 1997

[30] Foreign Application Priority Data

May 9, 1996 [DE] Germany ..... 196 18 625.0

[51] Int. Cl.[6] ..... F01P 3/06

[52] U.S. Cl. ..... 123/41.35

[58] Field of Search ..... 123/41.35

[56] References Cited

U.S. PATENT DOCUMENTS

| | | |
|---|---|---|
| 4,331,107 | 5/1982 | Bruni . |
| 4,530,312 | 7/1985 | Kanda et al. . |
| 4,587,932 | 5/1986 | Moebus . |
| 5,081,959 | 1/1992 | Akiyama . |

FOREIGN PATENT DOCUMENTS

| | | |
|---|---|---|
| 30 19 953 | 12/1980 | Germany . |
| 38 19 663 | 6/1989 | Germany . |
| 56-27400 | 9/1981 | Japan . |
| 60-132050 | 7/1985 | Japan . |
| 2-301 648 | 12/1990 | Japan . |

*Primary Examiner*—John T. Kwon
*Attorney, Agent, or Firm*—Klaus J. Bach

[57] ABSTRACT

In a liquid cooled piston for internal combustion engines having a cooling oil supply and at least one liquid passage which is formed in a top part of the piston bounded by a piston head, the liquid passage is inclined with respect to the piston head and has at least one inlet opening formed as a collection funnel leading to the highest point of the passage for receiving cooling oil and, in the region of the lowest point of the passage an outlet opening for the lubrication of a piston pin bearing disposed therebelow. The passage further includes a diffuser-shaped area widening in the flow direction of the cooling oil through the passage.

7 Claims, 2 Drawing Sheets

LIQUID-COOLED PISTON FOR INTERNAL COMBUSTION ENGINES

BACKGROUND OF THE INVENTION

The invention relates to a liquid cooled piston for internal combustion engines with a cooling oil supply and a duct including a collection funnel formed in the piston for collecting cooling oil from the oil supply and conducting it through the piston.

It is known to cool pistons of supercharged engines because of the high thermal load in the upper areas of the pistons. For this purpose, they have recessed cooling ducts formed therein which can be filled via injection nozzles with a cooling liquid, generally engine oil.

For pistons subject to high loading, the thermal load is especially high in the upper part of the pistons, particularly if the piston includes a combustion chamber recess. With conventional cooling, there is the risk of heat aging of the piston, as a result of which, for example, the alloy of the piston loses dimensional stability and strength.

On the other hand, it is known, for example in direct-injection diesel engines, that only the piston head becomes very hot, but not the walls of the combustion chamber which are cooled by the cooling water.

This may result in insufficient heating of the cooling water, so that, on one hand, additional heating of the passenger compartment is required, whereas on the other hand, the cooling of the piston with sufficient cooling oil is problematic.

It has been actually found that the heat flow in a piston is not uniform because of asymmetric boundary conditions resulting from the positioning of inlet and outlet valves, the arrangement of injection nozzles for the cooling oil, the shaping of a combustion recess, charge cycle influences and the effect of the cooling of the cylinder head. There are accordingly regions in an upper part of the piston which have pockets of heat and require a large reduction of their temperature level, but then there are other regions in which a lower temperature level prevails, such that too severe cooling could possibly lead in these regions to dew point corrosion, particularly with composite pistons.

A composite liquid-cooled piston is known, for example, from U.S. Pat. No. DE 38 19 663, to which injection oil is supplied and which is provided for application in four-stroke diesel engines operated by heavy oil. This piston has two outer hollow spaces and a central hollow space formed in the upper part and in the lower part of the piston. The coolant is fed to an outer hollow space and is then passed on to the central hollow space. The two outer hollow spaces are arranged one above the other and the coolant flows from one to the other, the lower hollow space into which the coolant enters first being arranged in a region of lower thermal loading.

In this known piston, the liquid duct is preferably arranged in such a way that the temperature level in the region of the piston ring grooves is maintained relatively high while the piston head plate is intensely cooled. Although different cooling intensities in the region of the piston ring grooves and the head plate of the piston are achieved, the solution known from U.S. Pat. No. DE 38 19 663 neglects the above mentioned asymmetrical boundary conditions in a piston since it has an essentially symmetrical arrangement of the cooling duct. As a result, there may be in the long term, heat-related damage in some areas of the piston.

It is the object of the present invention to provide a liquid-cooled piston for internal combustion engines, which has a long service life and in which a cooling duct is arranged in such a way that it is adapted to the asymmetrical thermal conditions in the piston and has a geometric shape which is adapted to the respective requirements for cooling.

SUMMARY OF THE INVENTION

In a liquid cooled piston for internal combustion engines having a cooling oil supply and at least one liquid passage which is formed in a top part of the piston bounded by a piston head, the liquid passage is inclined with respect to the piston head and has at least one inlet opening formed as a collection funnel leading to the highest point of the passage for receiving cooling oil and has, in the region of the lowest point of the passage, an outlet opening for the lubrication of a piston pin bearing disposed therebelow. The passage further includes a diffuser-shaped area widening in the flow direction of the cooling oil through the passage.

The liquid passage which is diffuser-shaped and widens in the flow direction of the cooling liquid changes the flow velocity of the cooling oil, so that there is a higher flow velocity in the region of a smaller duct cross-section, and a suction effect is generated in the region of a larger duct cross section. As a result, more rapid cooling is achieved in the diffuser-shaped widened area.

The part of the piston around the region with the narrower cross-section of the cooling duct undergoes a far greater cooling effect than the part of the piston disposed around the large cross-section area cooling duct. By an enlargement of the cross-section of the coolant duct, it is however possible, in a region which is subjected to high thermal loading, for the heat transfer of the coolant to be increased to such an extent that the coolant which is already slightly heated due to heat exchange in a preceding region of the cooling duct is sufficient for cooling that area.

This is particularly advantageous since the heat carrying capacity of the coolant in the duct is limited in geometrical terms, and an increase in the heat transfer can only be achieved via the flow velocity of, and the heat transfer conditions for, the coolant.

Moreover, with the diffuser-shaped widening an accumulation or return flow of the coolant at any point in the liquid duct is avoided.

With the cooling-liquid duct according to the invention, the temperature level can be kept approximately uniform for all areas of the piston, thus avoiding diminished strength due to aging in particular areas of the piston as a result of the effect of the heat.

The inclination of the axis of the coolant passage at an oblique angle with respect to the plane of the piston head is also quite advantageous. The inclination of the passage relative to the piston head assists the coolant to flow toward the coolant outlet. It avoids a "shaker effect", i.e. movement of the cooling oil up and down in the liquid duct as a result of the piston movement as it is known to occur in coolant passages arranged to be coplanar with the piston head. The proportion of energy of the cooling oil consumed by the shaker effect in conventional liquid-cooled pistons is often so high that the speed of the cooling liquid drops to the extent of an oil flow blockage. With an oblique arrangement of the coolant passage, this proportion of energy serves as flow inducing energy generator during upward acceleration of piston, thus increasing the flow velocity of the cooling oil flowing through the coolant passage. Of course, the oblique angle of the coolant passage enhances the coolant flow in the downward direction by the weight and the force of gravity of the cooling oil.

The induced cooling in the piston according to the invention results in a permanent high strength and dimensional stability of the piston and consequently increases the service life of the piston and thus lowers the operating costs.

Moreover, with a piston according to the invention, other advantages can be achieved in specific applications. It is for example, possible in direct injection diesel engines to cool the piston more effectively and to utilize the heat removed from the piston for heating the vehicle passenger compartment.

Further advantages and advantageous refinements of the invention will become apparent from the description of an exemplary embodiments given below with reference to the drawings:

DESCRIPTION OF PREFERRED EMBODIMENTS

Figure 1:
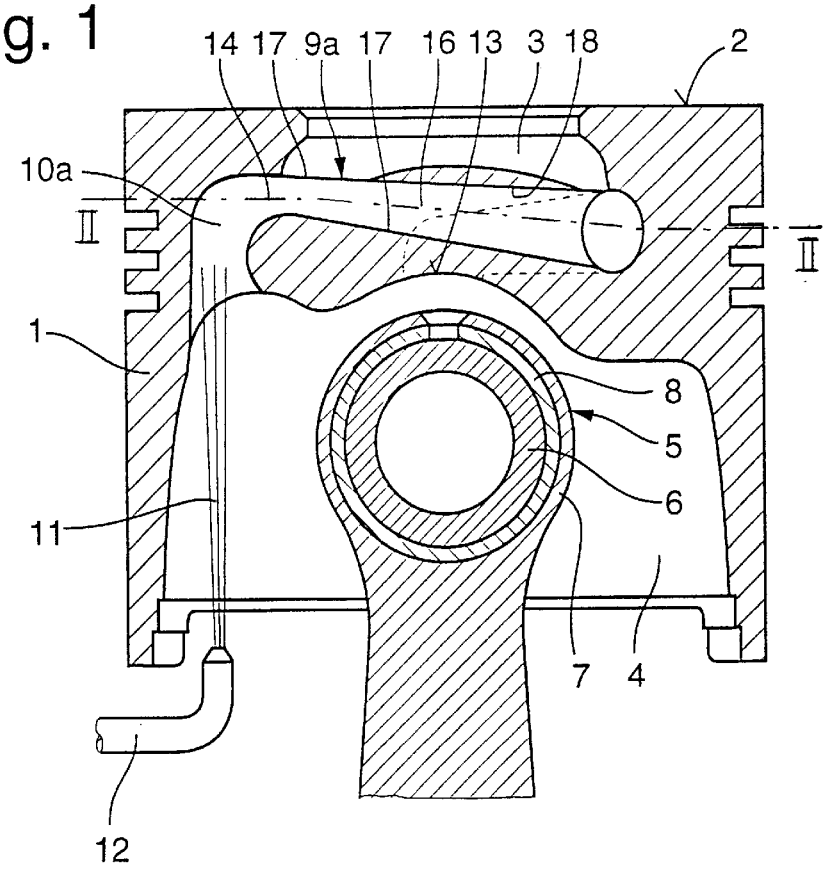
FIG. 1 is a cross-sectional view of a piston showing an axial section through the piston taken along line I—I of FIG. 2.
Figure 2:
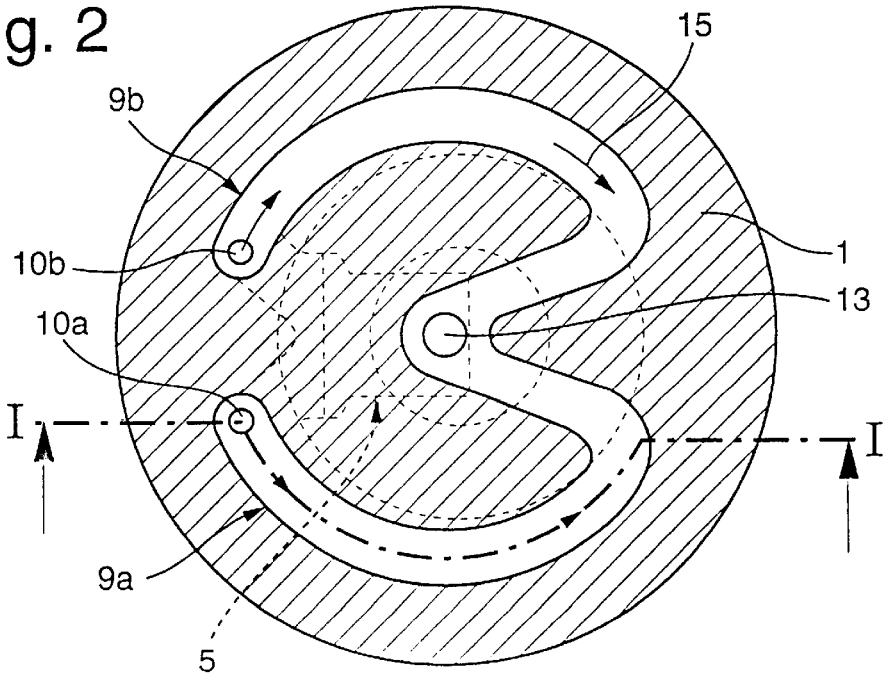
FIG. 2 is a cross-sectional view of the piston taken along line II—II of FIG. 1.

FIGS. 1 and 2 show a piston 1 for an internal combustion engine with a piston head 2 which includes a combustion chamber recess 3. Arranged in the open space 4 of the piston 1 is a piston-pin bearing 5 with a piston pin 6 mounted in a small-end bush 8 received in a connecting-rod eye 7. Two liquid passages 9*a* and 9*b* are formed in an upper region of the piston 1 above the open space 4. Each of these liquid passages has an inlet opening 10*a* and 10*b* respectively which both are formed as collection funnels and into which a cooling liquid 11, preferably cooling oil which at the same time is a lubricant, is injected by means of an injection nozzle 12. Both liquid passages 9*a*, 9*b* lead the coolant via a common outlet opening 13 back into the open space 4 and onto the piston pin bearing 5.

The injection nozzle 12 is inclined and positioned such that the coolant flow 11 will reach the passage funnel 10*a*, 10*b*, only intermittently.

As a result of the piston movement and the inclined arrangement of the injection nozzle 12, the injection of the cooling oil into the liquid ducts 9*a*, 9*b* takes place alternately, whereby a medium temperature level develops in the piston 1.

The transition region 14 between the collection funnel 10*a* and 10*b* and the liquid passage 9*a* and 9*b* is designed in each case in such a way that the injected cooling oil 11 enters the liquid passages 9*a*, 9*b* at their highest point in the piston 1, while the outlet opening 13 is arranged in the region of the lowest point of the liquid passages 9*a*, 9*b*.

From their highest point in the transition region 14 adjacent the collection funnel 10*a* or 10*b* up to the outlet opening 13, the liquid passages 9*a*, 9*b* are inclined downwardly since their axes extend at an oblique angle relative to the plane of the piston head 2.

Although the liquid passages 9*a*, 9*b* extend, in the exemplary embodiment shown in FIGS. 1 and 2 over their entire length at the same oblique angle with respect to the piston head 2, it is of course also possible for only a part of one of the liquid passages to have an oblique orientation relative to the plane of the piston head 2. The angle of the passage arrangement depends in each case on design parameters to be adapted to certain given conditions.

The liquid passages 9*a*, 9*b* are designed in a meandering manner in such a way that in each case the first third of their length after the inlet openings 10*a*, 10*b* in which the greatest heat exchange can be achieved lies in those regions of the piston 1 in which the highest temperature levels prevail and the further course of the passages is adapted to the asymmetrical heat distribution in the piston 1.

The transition region 14 between the collection funnel 10*a*, 10*b* and the coolant passages 9*a*, 9*b* is so arranged that the coolant 11 injected enters the coolant passage 8 at the highest point in the piston 1 whereas the discharge opening 13 is disposed at the lowest point of the coolant passage 9*a*, 9*b*. The coolant enters the coolant passage in the narrowest area thereof so that its flow velocity is high and there is also suction increasing the throughput of cooling oil which results in a more rapid cooling pattern.

The cross-section of the liquid passages 9*a*, 9*b* changes in such a way that each has a diffuser-shaped area 16 which widens in the flow direction of the cooling oil 11, which is indicated by the arrows 15. The widening is designed to be discontinuous. The passage includes cross-sectional steps 17 and turbulence promoting edges 18. The variation of the flow velocity of the cooing oil 11 thus produced prevents any return flow of cooling oil or oil blockage.

The cooling oil 11 which is injected under pressure into the passage always has, because of the inclined orientation of the liquid passages 9*a*, 9*b* and their design with the diffuser-shaped widening 16, a flow velocity as required for the desired cooling effect up to its discharge through the common outlet opening 13. From the outlet opening 13, the cooling oil is fed to the piston-pin bearing 5.

It is, of course, possible to provide other embodiments with a plurality of diffuser-shaped passage sections similar to a Carnot multiple diffuser, (not illustrated), and diffuser-shaped areas which, furthermore, extend only over a part of the length of the liquid passages.

Figure 3:
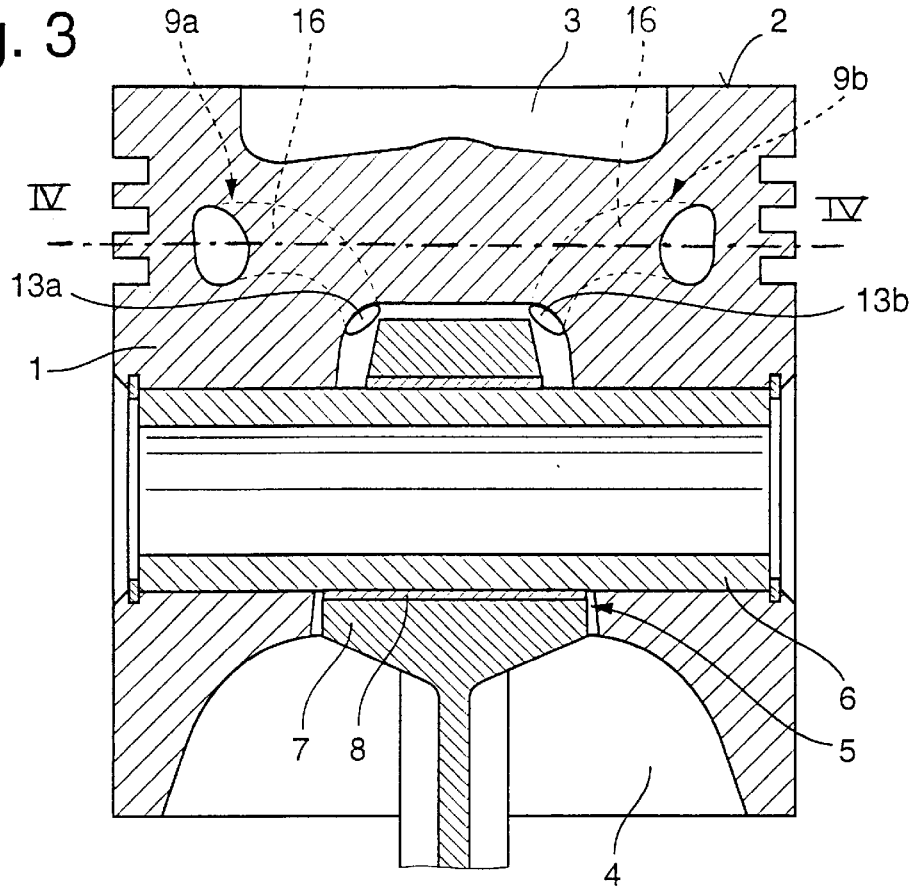
FIG. 3 shows another piston with a coolant passage in an axial cross-sectional view taken along line III—III of FIG. 4.
Figure 4:
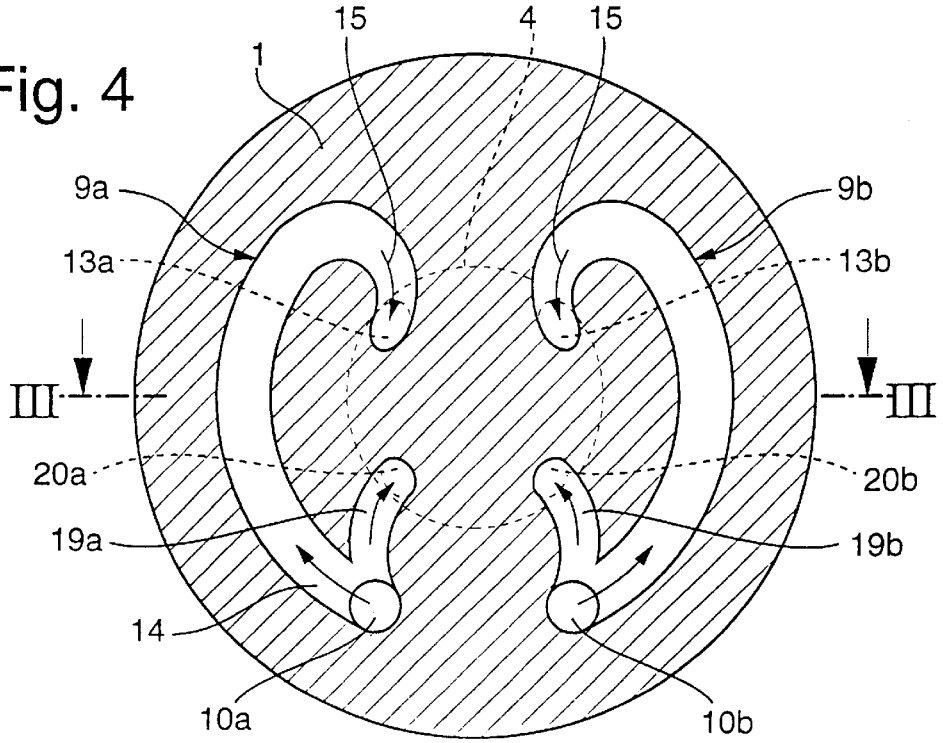
FIG. 4 is a cross-sectional view of the piston according to FIG. 3 taken along the line IV—IV of FIG. 3.

FIGS. 3 and 4 illustrate another exemplary embodiment of a piston 1 which corresponds in principle to the embodiment described with reference to FIGS. 1 and 2. Accordingly, elements having the same function are denoted by the same reference numerals.

According to FIGS. 3 and 4, two identical, separate liquid passages 9*a*, 9*b* are formed in the piston 1, each having a diffuser-shaped area 16. In the region of the inlet openings 10*a*, 10*b* a nose-like side duct 19*a*, 19*b* branches off from the liquid duct 9*a*, 9*b* and leads over a short distance 19*a*, 19*b* to an outlet opening 20*a*, 20*b* which opens out into the open space 4 and onto the piston-pin bearing 5.

Some of the cooling oil injected into the coolant duct 9*a*, 9*b*, thus passes via the side duct 19*a*, 19*b* to the piston-pin bearing 5 without being intensely heated while the rest is conducted through the liquid passage 9*a*, 9*b* to the outlet opening 13*a*, 13*b* to cool the piston 1.

The outlet openings 13*a*, 13*b*, 20*a*, 20*b* are arranged off-center with respect to the upper connecting rod eye 8 in the small-end bush 7, so that the cooling oil does not have to flow over the connecting rod eye 8 in order to pass to the bearing surfaces of the piston pin bearing 5. Rather the cooling oil is fed directly to the lateral end areas of the connecting rod eye 8 or the small-end bush 7 to wet the piston pin 6.

The side channels 19*a*, 19*b* thus further increase the cooling effectiveness for the piston 1.

Moreover, the supply of oil for the bearings is insured by the special side ducts 19*a* , 19*b*, even when the angular position of the connecting rod relative to the piston changes.

In any case the surface of the liquid passages 9*a*, 9*b* constitutes a superimposition of design deviations of the $1^{st}$ to the $4^{th}$ order in accordance with DIN 4760, wherein a high degree of roughness advantageously provides for turbulence in the passage which improves the heat transfer with a relatively large heat-exchange surface.

What is claimed is:

1. A liquid-cooled piston for internal combustion engines, said piston having a piston pin bearing, a piston head with a top surface and a piston skirt surrounding an open space, said piston head including at least one cooling liquid passage extending therethrough and having at least one inlet opening in the form of a collection funnel for receiving cooling oil from a cooling oil supply, said cooling liquid passage being inclined with respect to the piston head top surface and having, in the region of its lowest point, an outlet opening disposed above said piston pin bearing for lubrication of said piston pin bearing, said liquid passage further being, at least in a partial region of its length adjacent said collection funnel, diffuser shaped so as to widen in the flow direction of the cooling oil flowing through said liquid passage.

2. A piston according to claim 1, wherein the end of said collection funnel adjacent said liquid passage is disposed in the area of the highest point of the liquid passage in said piston head.

3. A piston according to claim 1, wherein said liquid passage has its narrowest cross-section in a transition region at the end of said collection funnel.

4. A piston according to claim 1, wherein a first third of the length of said liquid passage adjacent said inlet opening is arranged in an area said piston having the highest temperature level.

5. A piston according to claim 1, wherein two liquid flow passages are formed in said piston and joined at a common outlet opening, each flow passage having an inlet opening and means are provided for alternately charging said flow passages with cooling oil via said inlet openings.

6. A piston according to claim 5, wherein a side duct is formed in said piston in the region of each of said inlet openings, said side ducts branching off from the inlet area of said liquid passages and extending to said open space where they have outlet openings.

7. A piston according to claim 5, wherein said outlet openings are arranged off-center relative to said piston pin bearing.

* * * * *